US006471535B1

(12) United States Patent
Walkup et al.

(10) Patent No.: US 6,471,535 B1
(45) Date of Patent: Oct. 29, 2002

(54) ELECTRICAL SOCKET

(75) Inventors: William B. Walkup, Hillsboro, OR (US); Nick Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/017,876

(22) Filed: Dec. 12, 2001

(51) Int. Cl.[7] ..... H01R 13/625
(52) U.S. Cl. ..... 439/342
(58) Field of Search ..... 439/342, 259

(56) References Cited

U.S. PATENT DOCUMENTS 5,562,474 A * 10/1996 Lee ..... 439/342
5,649,836 A * 7/1997 Kashiwagi ..... 439/342
6,086,401 A * 7/2000 Hsiung et al. ..... 439/342
6,142,811 A * 11/2000 Lin ..... 439/342
6,213,807 B1 * 4/2001 Huang et al. ..... 439/342
6,152,757 A1 * 11/2001 Szu ..... 439/342
6,328,587 B1 * 12/2001 Hsu ..... 439/342

* cited by examiner

*Primary Examiner*—Gary F. Paumen
(74) *Attorney, Agent, or Firm*—Wei Te Chung

(57) ABSTRACT

An electrical socket (1) for supporting a CPU to electrically connect with a PCB comprises a non-conductive base (2) defining plural rows of through holes (21), a plurality of terminals (4) retained in corresponding through holes, and a slidable cover (3) mounted on the base. Each terminal has a retaining portion (41), a soldering portion (43) and a mating beam (42) extending from opposite ends of the retaining portion, respectively. The mating beam extends slantedly and upwardly from the retaining portion beyond a top face (23) of the base for conductively contacting a corresponding pin (6) of the CPU.

14 Claims, 6 Drawing Sheets

ELECTRICAL SOCKET

BACKGROUND OF THE INVENTION

1. Field of the Invention

The present invention relates to an electrical socket, and particularly to a CPU socket having improved conductive contacts.

2. Description of Prior Art

A CPU socket is widely used for supporting the CPU to electrically connect with an underlying printed circuit board (PCB). In order to be competitive, the CPU socket must have good-performance contacts and fine contact pitch.

Referring to FIGS. 8 and 9, a prior art contact 60 used for a CPU socket and a contact carrier 70 for producing the contacts 60 are shown, respectively. The contact carrier 70 is stamped and formed from a metal sheet, and is formed with a contact strip 66 and a plurality of contacts 60 arranged side-by-side and connected with the contact strip 66 by a number of links 65. Each link 65 is commonly connected to every two adjacent contacts 60 and is aligned with a corresponding positioning hole 67 defined in the contact strip 66. The contact 60 has a wide retaining body 61, a mating arm 63 and a soldering portion 64 extending from opposite ends of the retaining body 61. The retaining body 61 forms several barbs 611 on opposite sides thereof for retaining in the base of the socket. The mating arm 63 is adapted for conductively contacting with a pin 7 of a CPU (not shown), and extends crookedly from the retaining body 61 to be long enough for achieving needed compliance. Such a crooked and long shape of the mating beam 63 makes the whole contact 60 fairly wide or fat and thus the contact pitch of the contact carrier 70 cannot be reduced without sacrificing the needed compliance.

Hence, an improved conductive contact used for an electrical socket is required to overcome the disadvantages of the prior art.

BRIEF SUMMARY OF THE INVENTION

An object of the present invention is to provide an electrical socket having fine contact pitch and good performance.

Another object of the present invention is to provide an electrical socket having conductive contacts which have a simple structure while maintaining good performance.

To fulfill the above-mentioned objects, an electrical socket in accordance with the present invention is used for supporting CPU to electrically connect with a PCB. The electrical socket comprises a non-conductive base defining plural rows of through holes, a plurality of conductive terminals inserted into corresponding through holes, and a slidable cover mounted on the base. Each terminal has a retaining portion, a soldering portion and a mating beam extending from opposite ends of the retaining portion, respectively. The mating beam extends slantedly and upwardly from the retaining portion and locates beyond a top face of the base for conductively contacting a corresponding pin of the CPU. The slidable cover has a plate body defining plural rows of pin holes corresponding to the through holes for insertion of pins of the CPU, and plural elongate ribs depending from the body plate to be mounted between every two adjacent rows of terminals retained in the base.

Other objects, advantages and novel features of the invention will become more apparent from the following detailed description of the present embodiment when taken in conjunction with the accompanying drawings.

DETAILED DESCRIPTION OF THE INVENTION

Reference will be made to the drawings below for detailed description of the present invention.

Figure 1:
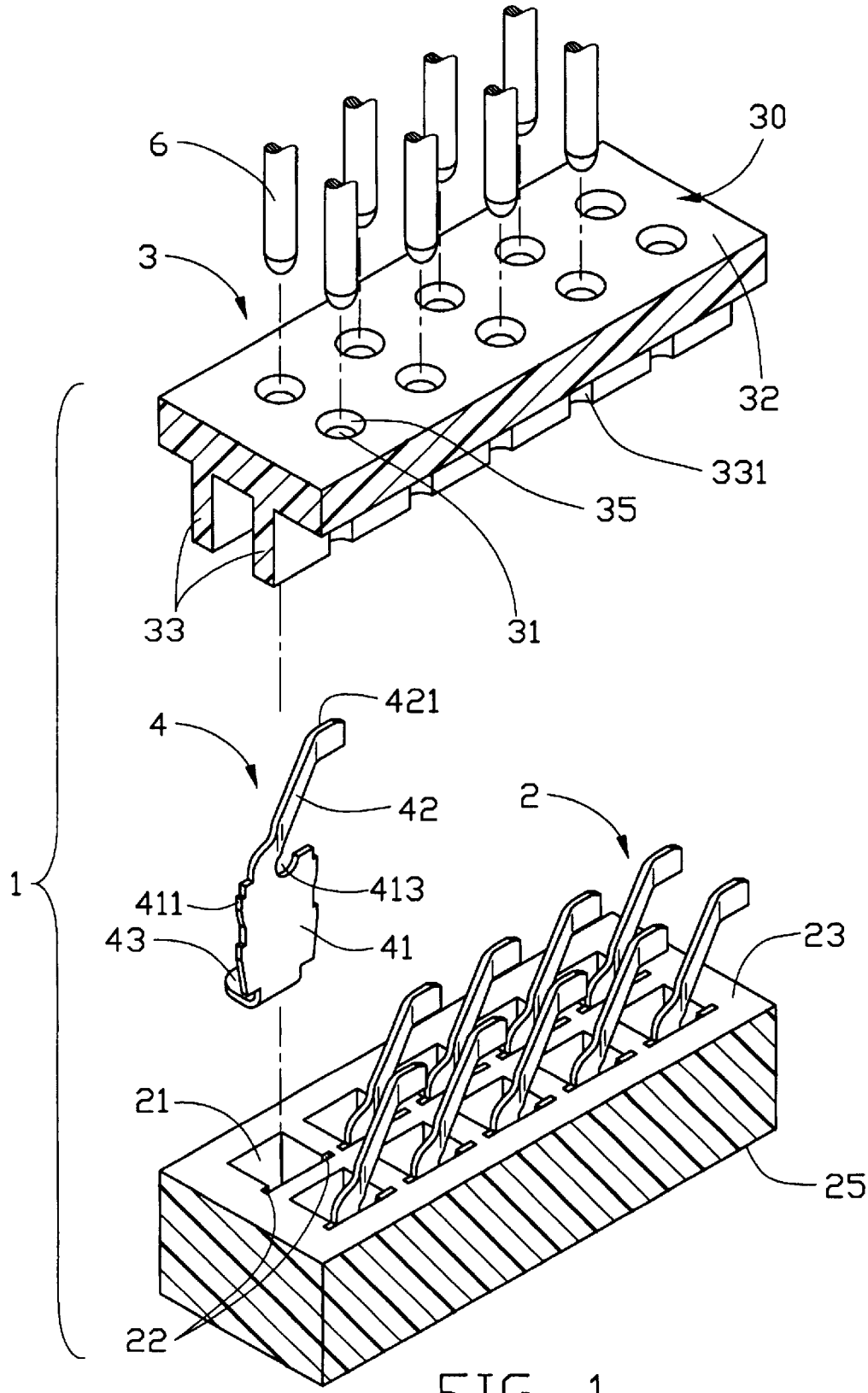
FIG. 1 is a cross-sectional, partially exploded perspective view of an electrical connector in accordance with the present invention.

Referring to FIG. 1, an electrical socket 1, such as a ZIF BGA socket, in accordance with the present invention is shown in a perspective and partial cross-sectional view, and comprises a non-conductive base 2, a plurality of terminals 4 retained in the base 2, and a slidable cover 3 for covering the base 2.

The non-conductive base 2 defines plural rows of terminal holes 21 extending from a mating face 23 to a mounting face 25 thereof for receiving respective terminals 4. Additionally, a pair of slits 22 are defined beside and communicating with each terminal hole 21.

Figure 2:
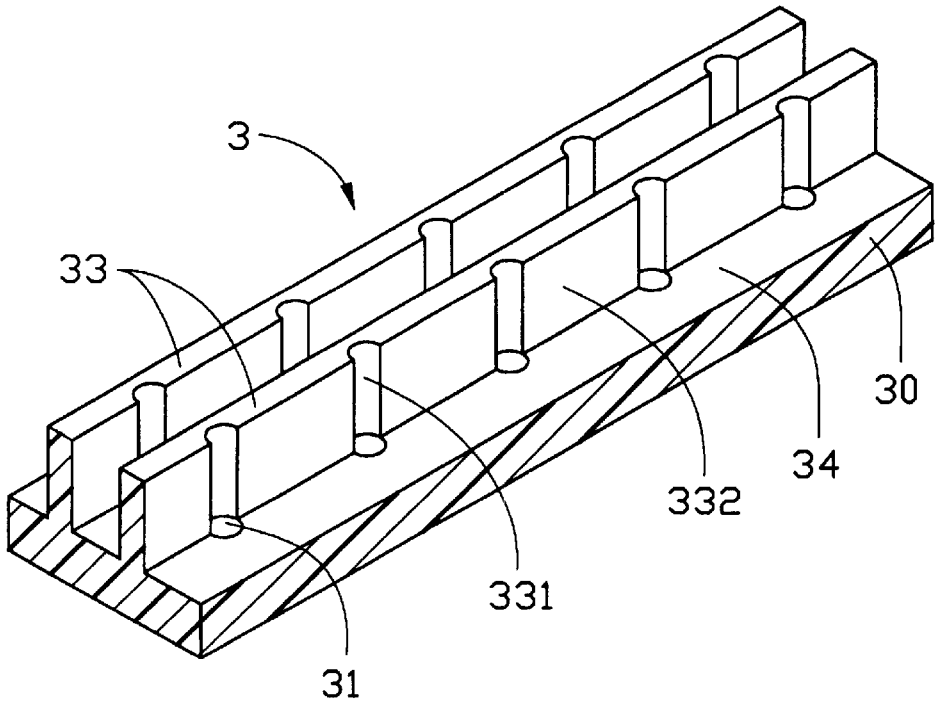
FIG. 2 is another perspective view of a movable cover of the electrical connector of FIG. 1.

Further referring to FIG. 2, the slidable cover 3 is adapted for supporting a PGA integrated circuit package or chip, such as a CPU (not shown), and has a plate body 30 and a plurality of elongate ribs 33 depending from a bottom face 34 of the plate body 30. The plate body 30 defines plural rows of pin holes 31 extending from a top face 32 thereof to the bottom face 34 for insertion of corresponding pins 6 of the CPU. Each pin hole 31 has a tapered portion 35 at an upper end thereof for easy insertion of the pin 6. Each elongate rib 33 extends along a row of pin holes 31 and defines a plurality of arc-shaped recesses 331 in a side surface 332 thereof. Each recess 331 is aligned and communicated with a corresponding pin hole 31 for cooperatively retaining a corresponding pin 6 therein.

Figure 3:
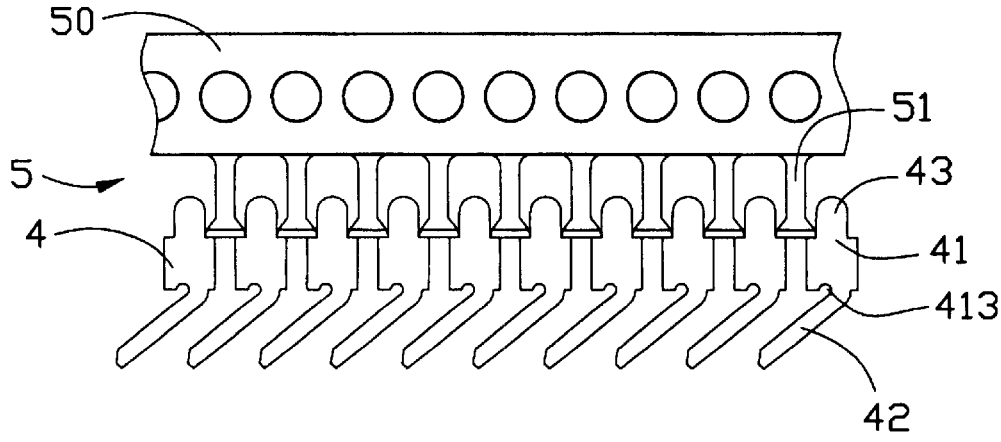
FIG. 3 is a planar view of a contact carrier for producing terminals associated with the electrical connector of FIG. 1.
Figure 4:
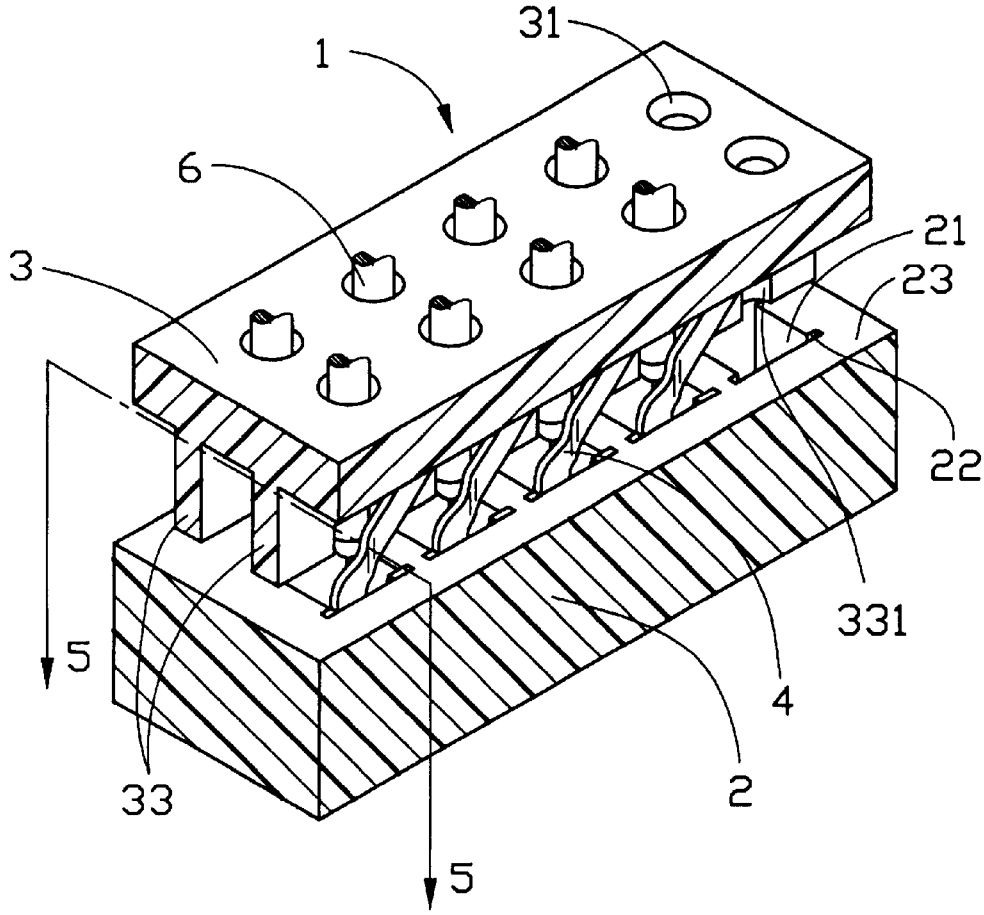
FIG. 4 is an assembled view of FIG. 1 wherein the movable cover is in a first open position.
Figure 5:
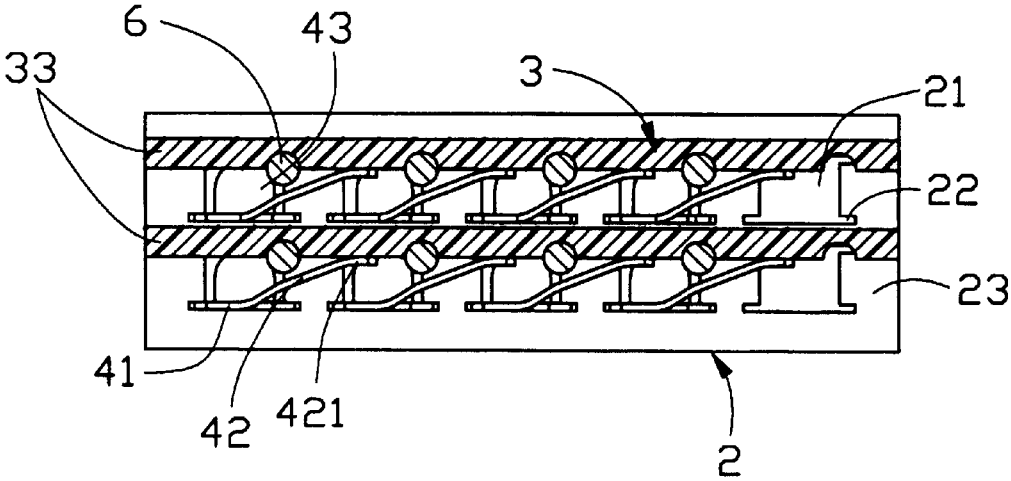
FIG. 5 is a cross-sectional view taken along line 5—5 of FIG. 4.
Figure 6:
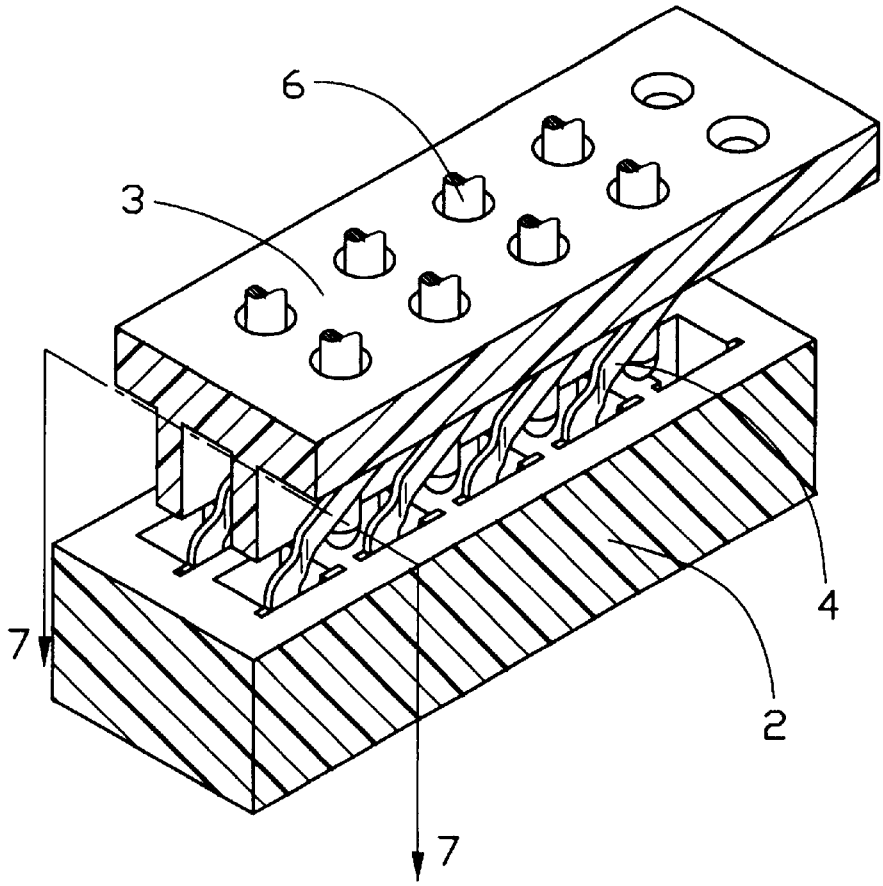
FIG. 6 is an assembled view of FIG. 1 wherein the movable cover is in a second closed position.
Figure 7:
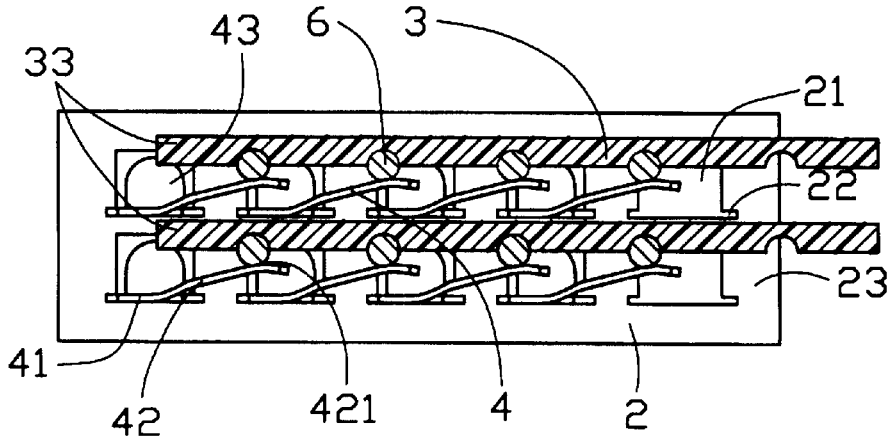
FIG. 7 is a cross-sectional view taken along line 7—7 of FIG. 6.
Figure 8:
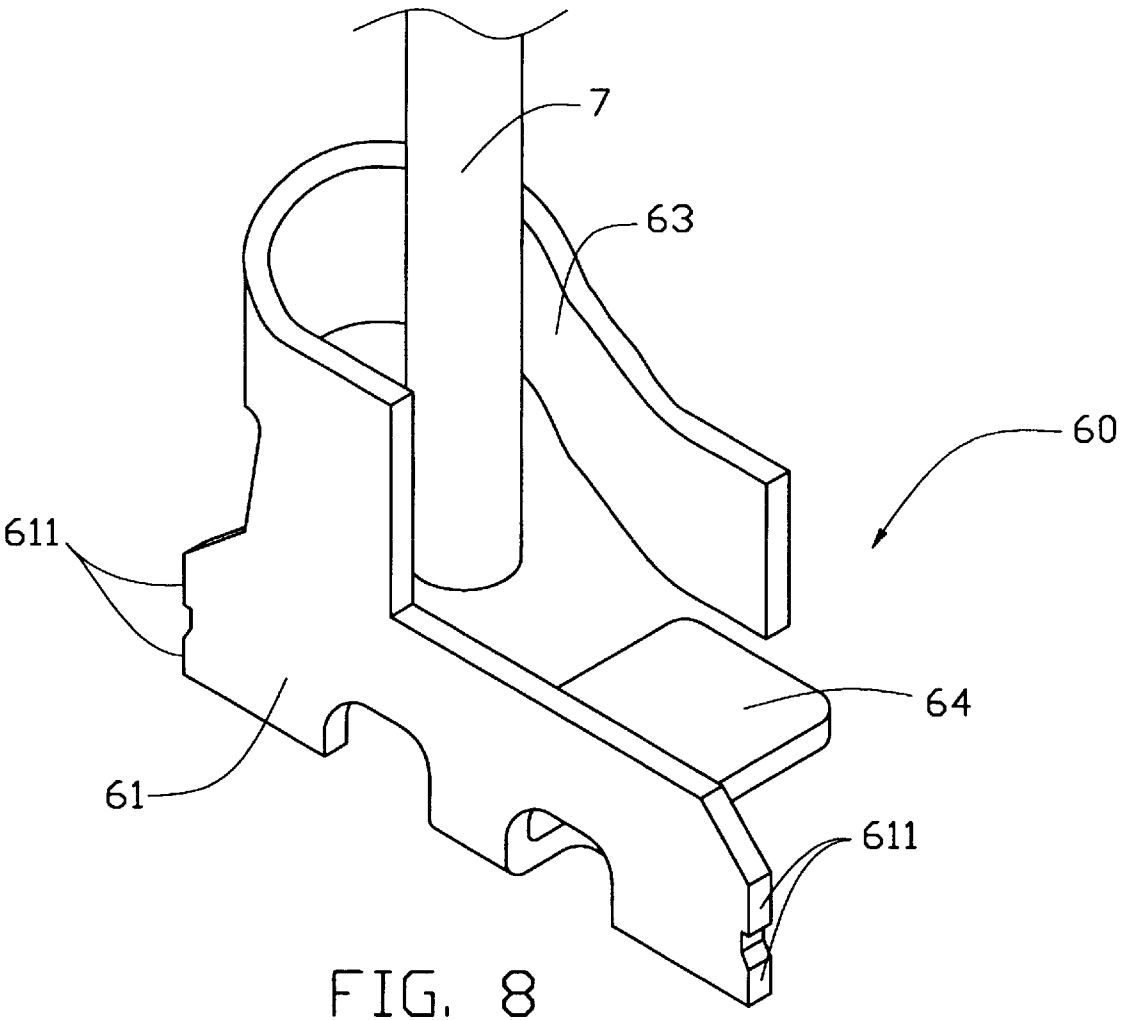
FIG. 8 (PRIOR ART)
FIG. 8 is a perspective view of a prior art contact together with a pin of a CPU engaged therewith.
Figure 9:
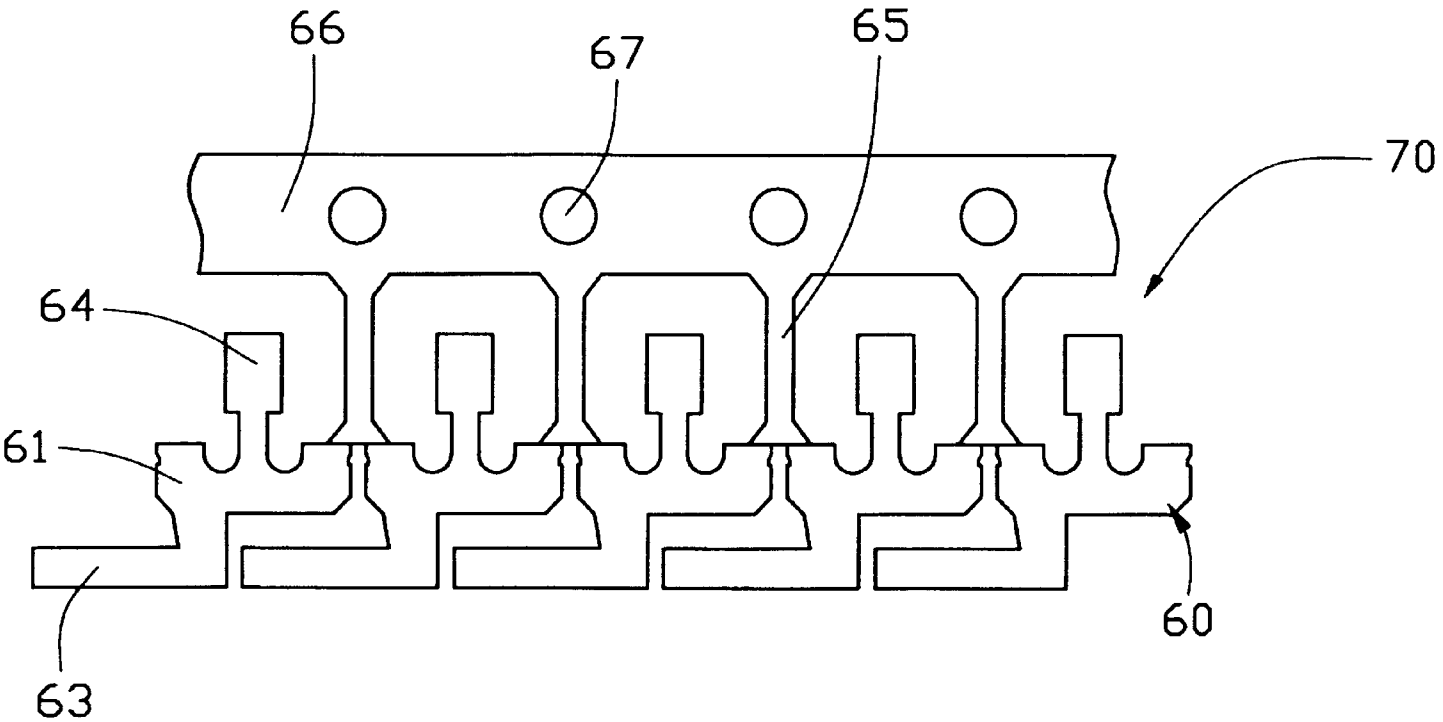
FIG. 9 (PRIOR ART)
FIG. 9 is a planar view of a contact carrier for producing the contacts of FIG. 8.

Referring to FIGS. 1 and 3, a contact carrier 5 is stamped and formed from a metal sheet and has a carrier strip 50 connected with a plurality of terminals 4 by a corresponding number of links 51. The carrier strip 50 has a plurality of positioning holes 52 each corresponding to one link 51 and the link 51 is connected between every two adjacent terminals 4. An intermediary holding tool (not shown) grabs the terminals 4 during removing the carrier strip 50 and then the terminals 4 are inserted into corresponding terminal holes 21 from above of the base 2. Each terminal 40 has a retaining portion 41, a soldering portion 43 and a mating beam 42 extending from opposite ends of the retaining portion 41, respectively. The retaining portion 41 forms several barbs 411 on opposite sides thereof for being interferingly retained in the slits 22 of the base 2. Additionally, the retaining portion 41 defines a cutout 413 adjacent to the mating beam 42 for facilitating the resilient deformation of the mating beam 42. The mating beam 42 extends slantedly upwardly and forwardly from the retaining portion 41 as to cross over the mating arm 42 of a next terminal 4 in the same row for achieving needed compliance. The mating beam 42 has a contact portion 421 at an upper end thereof for conductively contacting with the pin 6 of the CPU. The soldering portion 43 bends vertically from the retaining portion 41 for soldering to the underlying circuit board by a corresponding solder ball (not shown) connected thereto.

In assembly, referring to FIGS. 4 to 7, the terminals 4 are first inserted into corresponding terminal holes 21 from above of the base 2, with the aid of the intermediary holding tool, until the barbs 411 of the retaining portions 41 are interferingly retained in corresponding slits 22 of the base 2. The pins 6 of the CPU are inserted into corresponding pin holes 31 and associated recesses 331 of the cover 3 and then the cover 3 together with the CPU are attached on the non-conductive base 2. The elongate ribs 33 of the cover 3 are mounted onto the base 2, and each is located between every two adjacent rows of terminals 4 retained in the base 2. Additionally, each elongate rib 33 is in contact with the convex contact portions 421 of a corresponding row of terminals 4 such that preload force is imparted to each mating beam 42. In use, the cover 3 moves along the row direction of the terminal holes 21 with respect to the base 2 until the contact portions 421 of the terminals 4 conductively contact with corresponding pins 6. Thus, the pins 6 of the CPU are electrically connect with the underlying circuit board 1 through the terminals 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical socket for supporting an integrated circuit chip to electrically connect with a printed circuit board (PCB), comprising:

a non-conductive base defining plural rows of through holes;

a plurality of terminals each having a retaining portion retained in a corresponding through hole, a mating beam extending slantedly and upwardly from one end of the retaining portion as to cross over a terminal retained in a next through hole of a same row, and a soldering portion extending from another end of the retaining portion for soldering to the PCB; and a cover slidable relative to and being mounted on the base and defining plural rows of pin holes corresponding to the through holes for insertion of pins of the integrated circuit chip.

2. The electrical socket as claimed in claim 1, wherein the mating beam of each terminal extends beyond a top surface of the non-conductive base and is angled from a plane where the retaining portion is located.

3. The electrical socket as claimed in claim 2, wherein the mating beam forms a convex contact portion at an upper end thereof for conductively contacting with a corresponding pin of the integrated circuit chip.

4. The electrical socket as claimed in claim 3, wherein the retaining portion defines a cutout adjacent to the mating beam and forms several barbs on opposite sides thereof to be interferingly retained in the through hole of the base.

5. The electrical socket as claimed in claim 1, wherein the cover has a plate body containing said rows of pin holes, and a plurality of elongate ribs project downwardly from a bottom face of the body plate.

6. The electrical socket as claimed in claim 5, wherein each elongate rib is corresponding to a row of pin holes and defines a plurality of arc-shaped recesses, each recess communicating with one pin hole for receiving a corresponding pin of the integrated circuit chip.

7. The electrical socket as claimed in claim 6, wherein the elongate ribs are mounted on a top surface of the non-conductive base and each is located between every two adjacent rows of terminals.

8. The electrical socket as claimed in claim 7, wherein the contact portions of one row of terminals are in contact with an adjacent elongate rib when the slidable cover is in a first position, and they are conductively contacted with corresponding pins of the integrated circuit chip when the slidable cover is in a second position.

9. An electrical socket for supporting an integrated circuit chip to electrically connect with a printed circuit board (PCB), comprising:

a non-conductive base defining plural rows of through holes;

a plurality of conductive terminals being inserted into corresponding through holes, each terminal having a retaining portion, a soldering portion and a mating beam extending from opposite ends of the retaining portion, respectively, the mating beam extending beyond a top face of the non-conductive base for conductively contacting a corresponding pin of the integrated circuit chip; and a slidable cover having a plate body and plural elongate ribs depending from the body plate and mounted on the non-conductive base, the plate body defining plural rows of pin holes corresponding to the through holes for insertion of pins of the integrated circuit chip;

wherein each elongate rib corresponds to one row of pin holes of the slidable cover and defines a plurality of arc-shaped recesses in a lateral side thereof, each recess communicating with a corresponding pin hole for receiving the corresponding pin of the integrated circuit chip.

10. The electrical socket as claimed in claim 9, wherein each elongate rib is located between every two adjacent rows of the terminals.

11. The electrical socket as claimed in claim 9, wherein each pin hole has a tapered portion at an upper end thereof for easy insertion of the pin of the integrated circuit chip.

12. The electrical socket as claimed in claim 9, wherein the mating beam of each terminal retained in one terminal hole extends slantedly and upwardly from the retaining portion to form a convex contact portion at an upper end thereof, and the contact portion crosses over a terminal retained in a next terminal hole of a same row.

13. The electrical socket as claimed in claim 12, wherein the contact portions of one row of terminals retained in the base are abutted against an adjacent elongate rib when the slidable cover is in a first position, and they are conductively contacted with corresponding pins of the integrated circuit chip when the slidable cover is in a second position.

14. An electrical connector assembly for use with an electronic device having pin type conductors thereof, comprising:

a dielectric base defining a plurality of through holes therein;

a plurality of terminals assembled to the base, each of said terminals including a retaining portion retainably received within the corresponding through hole, a mating beam extending from said retaining portion above said base; and a dielectric cover slidably mounted on the base along a direction with a plurality of pin holes therein, said cover including at least an elongated rib extending along said direction; wherein a free tip of the mating beam of each terminals abuts against the rib in a pre-loaded manner before said electronic device is coupled to the connector.

* * * * *